US006804363B2

(12) United States Patent
Yamasaki et al.

(10) Patent No.: US 6,804,363 B2
(45) Date of Patent: Oct. 12, 2004

(54) ELECTROACOUSTIC TRANSDUCER

(75) Inventors: Takashi Yamasaki, Tokyo (JP); Kenichi Kidokoro, Tokyo (JP)

(73) Assignee: Rion Co., Ltd., Tokyo (JP)

( * ) Notice: Subject to any disclaimer, the term of this patent is extended or adjusted under 35 U.S.C. 154(b) by 0 days.

(21) Appl. No.: 10/297,141

(22) PCT Filed: Apr. 11, 2002

(86) PCT No.: PCT/JP02/03622

§ 371 (c)(1),
(2), (4) Date: Dec. 3, 2002

(87) PCT Pub. No.: WO03/086012

PCT Pub. Date: Oct. 16, 2003

(65) Prior Publication Data

US 2003/0194102 A1 Oct. 16, 2003

(51) Int. Cl.[7] ..... H04R 25/00
(52) U.S. Cl. ..... 381/174; 381/191
(58) Field of Search ..... 381/113, 116, 381/173, 174, 190, 191; 29/25.41, 25.42; 367/170, 181; 307/400

(56) References Cited

U.S. PATENT DOCUMENTS 4,730,283 A * 3/1988 Carlson et al. ..... 367/181
5,255,246 A * 10/1993 van Halteren ..... 367/170
6,169,810 B1 1/2001 van Halteren et al.

FOREIGN PATENT DOCUMENTS

| | | |
|---|---|---|
| BR | 7907133 | 11/1979 |
| CA | 1107382 | 8/1981 |
| EP | 485653 | 11/1979 |
| FR | 2 511 571 | 2/1983 |
| GB | 2 111 799 A | 7/1983 |
| JP | 55-66199 | 5/1980 |
| JP | 58-41000 | 3/1983 |

* cited by examiner

*Primary Examiner*—Huyen Le
(74) *Attorney, Agent, or Firm*—Carrier Blackman & Associates, P.C.; Joseph P. Carrier; William D. Blackman

(57) ABSTRACT

An electroacoustic transducer comprises a carrier portion, a diaphragm supported by the carrier portion, an electrode portion opposed to the diaphragm at a predetermined interval, and a housing accommodating the diaphragm and the electrode portion, wherein the carrier portion has a saucer-like shape, at the bottom surface of which a plurality of upstanding posts are provided, and wherein the upper surface of the periphery of the carrier portion and the upper end surfaces of the posts are in the same plane, the diaphragm is bonded to the surface of the periphery of the carrier portion and the end surfaces of the posts, and the electrode portion is fixed to the end surfaces of the posts which are covered by the diaphragm with spacers interposed therebetween.

16 Claims, 4 Drawing Sheets

ELECTROACOUSTIC TRANSDUCER

BACKGROUND OF THE INVENTION

1. Technical Field

The present invention relates to an electroacoustic transducer in which a diaphragm supported by a carrier portion and an electrode portion opposed to the diaphragm at a predetermined interval are accommodated in a housing, such as a microphone for use in a hearing aid or the like.

2. Background Art

As a conventional microphone for use in a hearing aid, as disclosed in U.S. Pat. No. 6,169,810 B1, there has been known an electroacoustic transducer in which a diaphragm having a conductive layer and an electrode portion having an electret layer are accommodated in a housing in a state where the electrode portion is opposed to the diaphragm at a predetermined interval by clamping the diaphragm on a frame-shaped carrier having inwardly-extending supporting portions and placing the electrode portion on the supporting portions with spacers interposed therebetween.

However, as for such a diaphragm clamped on a frame-shaped carrier having inwardly-extending supporting portions, the amplitude in response to sound waves is greatly limited compared to a case of no supporting portions because the supporting portions are a point where the vibration of the diaphragm is initiated.

In addition, since the carrier is a rectangular shaped frame body, there is a problem that the carrier cannot keep its flatness due to a strain or twist which is applied thereto along the diagonal. Such a problem has an undesirable influence on the tension of the diaphragm or the interval between the diaphragm and the electrode portion. Therefore, since it is necessary to prevent the carrier from being subject to a strain or twist at the time of assembling an electroacoustic transducer, the stable manufacture of an electroacoustic transducer is difficult.

SUMMARY OF THE INVENTION

In order to solve the above-mentioned problems, the object of the present invention is to provide an electroacoustic transducer, characterized in that the desirable tension of a diaphragm is not changed over time, the interval between the diaphragm and the electrode portion can accurately be kept or maintained over time, the amplitude of the diaphragm in response to sound waves can be increased, and the influence of an external force can be reduced.

According to an aspect of the present invention, there is provided an electroacoustic transducer comprising a carrier portion, a diaphragm supported by the carrier portion, an electrode portion opposed to the diaphragm at a predetermined interval, and a housing for accommodating the diaphragm and the electrode portion, wherein the carrier portion has a saucer-like shape, at the bottom surface of which a plurality of posts are provided, and wherein the surface of the periphery of the carrier portion and the end surfaces of the posts are in the same plane, the diaphragm is bonded to the surface of the periphery of the carrier portion and the end surfaces of the posts, and the electrode portion is fixed to the end surfaces of the posts which are covered by the diaphragm with spacers interposed therebetween.

According to another aspect of the present invention, in the above-mentioned electroacoustic transducer, the diaphragm is formed in a film shape having a conductive layer provided on the surface of the diaphragm which faces the electrode portion or the other/opposite surface of the diaphragm, and the electrode portion has an electret layer and also has protruding portions provided on the surface of the electrode portion which faces the diaphragm, the protruding portions functioning as the above-mentioned spacers.

According to another aspect of the present invention, in the above-mentioned electroacoustic transducer, a sound guide port is provided at the bottom of the carrier portion, and the inside of the housing is divided into a first acoustic chamber and a second acoustic chamber by bonding the bottom of the carrier to the bottom surface of the housing and bonding the periphery of the sound guide port to the inside wall of the housing.

According to another aspect of the present invention, in the above-mentioned electroacoustic transducer, the carrier portion is formed by an etching process.

DETAILED DESCRIPTION OF THE INVENTION

Best Mode for Carrying out the Invention

Figure 1:
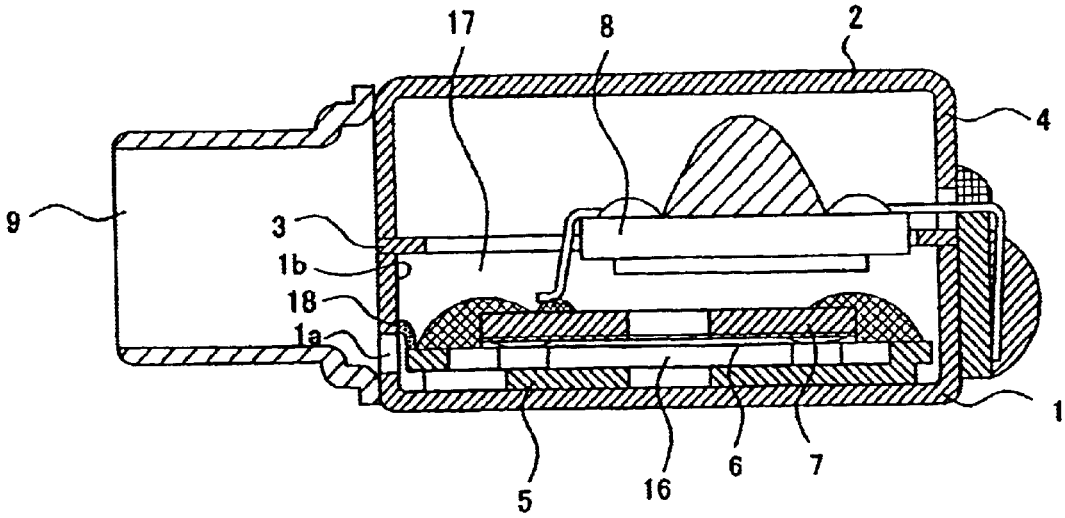
FIG. 1 shows an enlarged cross-sectional view of a portion of the electroacoustic transducer according to the present invention.

As shown in FIG. 1, in an electroacoustic transducer according to the present invention, a housing 4 is formed by interposing a frame member 3 between a case member 1 and a cover member 2. The housing 4 accommodates a diaphragm 6 and an electrode portion 7 fixed to a carrier portion 5. Reference numeral 8 refers to an amplifier and reference numeral 9 refers to a sound inlet opening.

Figure 3:
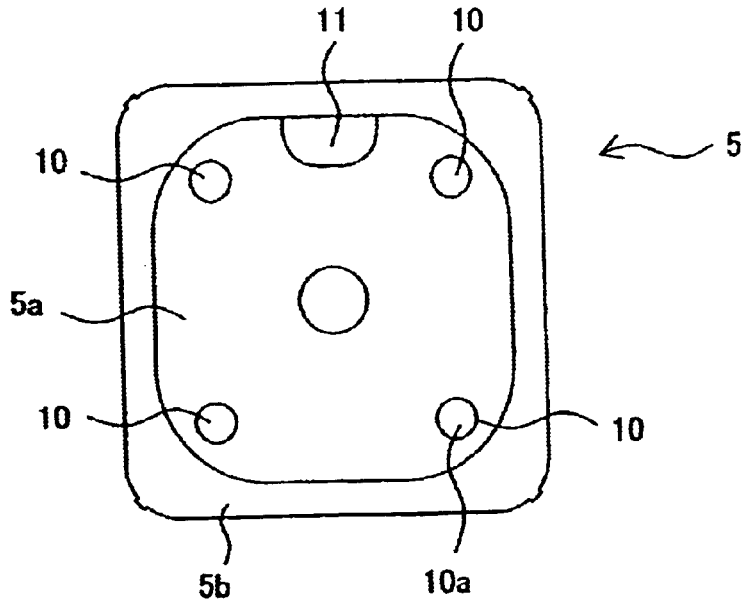
FIG. 3 shows a plane view of a carrier portion of the electroacoustic transducer according to the present invention.
Figure 4:
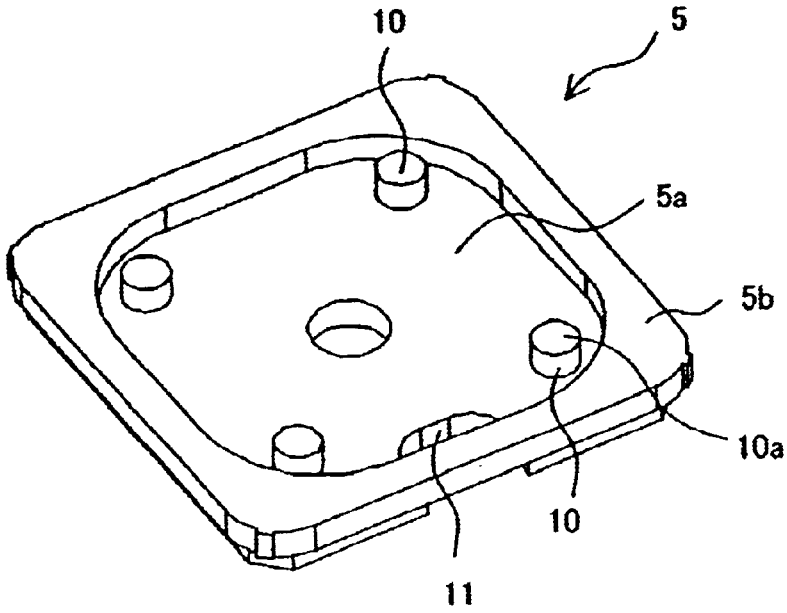
FIG. 4 shows a perspective view of the carrier portion of the electroacoustic transducer according to the present invention.
Figure 5A:
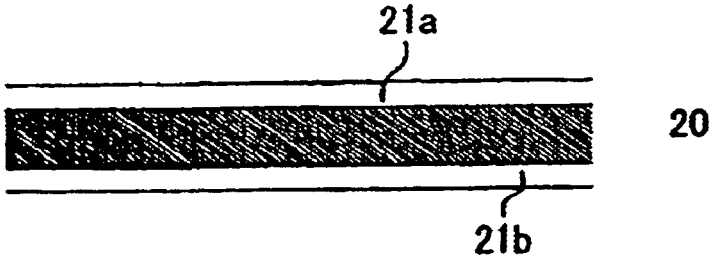
FIGS. 5(*a*)–5(*e*) explain etching process steps of the carrier portion.
Figure 5B:
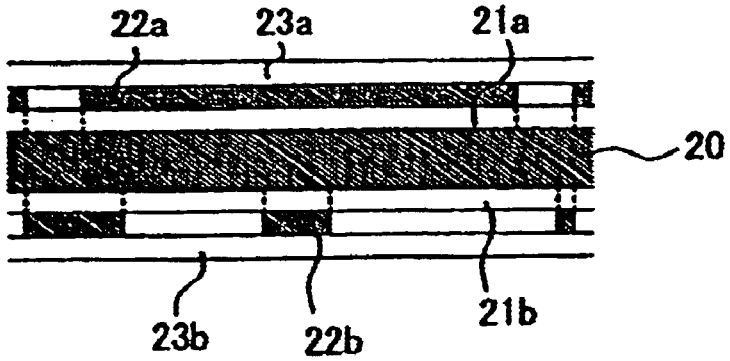
Figure 5C:
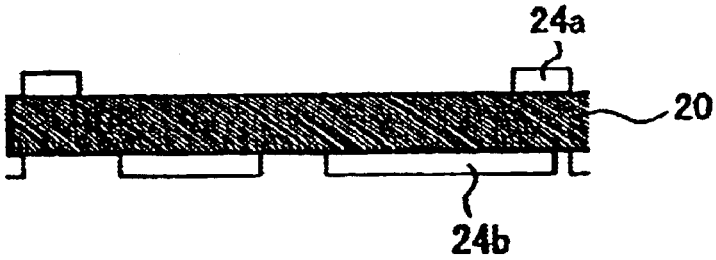
Figure 5D:
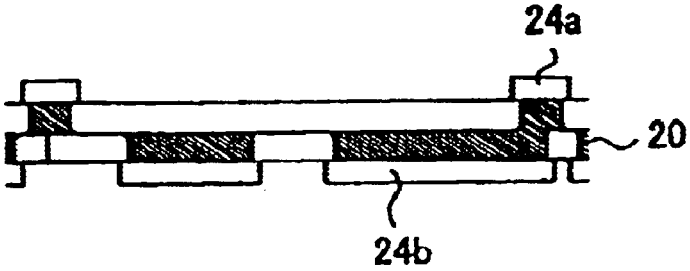
Figure 5E:
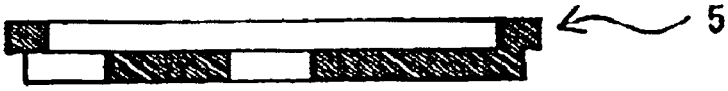

As shown in FIGS. 3 and 4, the carrier portion 5 is formed in a rectangular saucer-like shape, having a central recess defined above a bottom surface 5*a* and surrounded by a periphery, which is accommodated in the case member 1. In the four corners of the bottom surface 5*a* of the carrier portion 5, there are provided upstanding posts 10 in an island-like pattern, and the upper surface 5*b* of the periphery of the carrier portion 5 and the end surfaces 10*a* of the posts 10 are formed in the same plane. Reference numeral 11 refers to a sound guide port 11 for guiding sound waves. Since the carrier portion 5 is formed by an etching process as mentioned below, it is possible to prevent a strain or stress from being left in the carrier portion 5 which may occur in a case of press processing. Also, since the carrier portion 5 is formed in a saucer-like shape having a bottom portion rather than a frame shape with no bottom portion, the carrier portion 5 has a strong structure with respect to external forces compared to a frame-shaped carrier.

Figure 2:
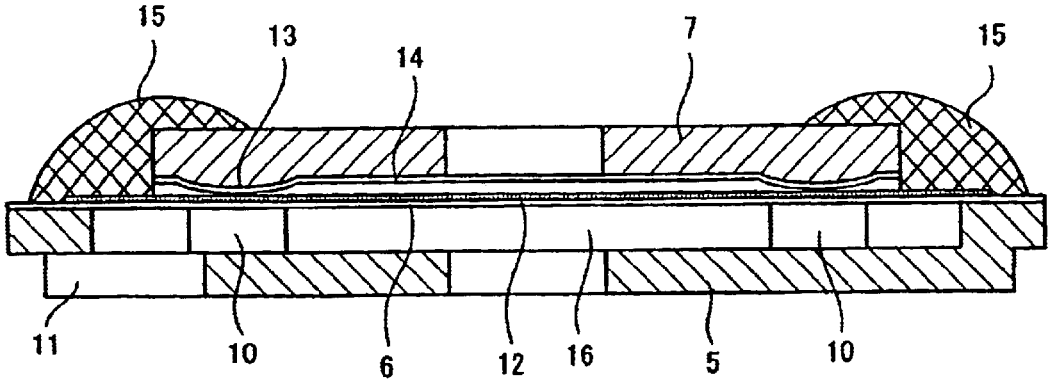
FIG. 2 shows an enlarged cross-sectional view of the electroacoustic transducer according to the present invention.

As shown in FIG. 2, the diaphragm 6 is formed in a film shape having a conductive layer 12 provided on the surface of the diaphragm 6 which faces the electrode portion 7. The diaphragm 6 is bonded in a state of desired tension to the surface 5*b* of the periphery of the carrier portion 5 and the end surfaces 10*a* of the posts 10 to which an adhesive has been applied. Since the carrier portion 5 is formed by an etching process so as to have no influence of a strain nor stress, the variation in the tension of the diaphragm 6 is kept to be uniform even when the ambient temperature varies. Also, since the surface 5*b* of the periphery of the carrier portion 5 and the end surfaces 10*a* of the posts 10 are in the same plane, uniform and desired tension of the diaphragm 5 can be achieved. It should be noted that the diaphragm 6 may be formed in a film shape having a conductive layer 12 provided on the surface of the diaphragm 6 which is opposite to the surface of the diaphragm 6 which faces the electrode portion 7.

The electrode portion 7 has an electret layer 14 and also has protruding portions 13 provided on the surface of the electrode portion 7 which faces the diaphragm 6. The electrode portion 7 is fixed to the carrier portion 5 by an adhesive 15 in a state where the protruding portions 13 abut on the end surfaces 10*a* of the posts 10 which are covered by the diaphragm 6. Again, the protruding portions function as spacers between the electrode portion 7 and the surfaces of the posts 10. Since the end surfaces 10*a* of the posts 10 in the four corners of the carrier portion 5 are formed so as to be in the same plane by an etching process, it is easy to keep the diaphragm 6 and the electret layer 14 of the electrode portion 7 parallel at a certain interval.

The bottom of the carrier portion 5 having the diaphragm 6 and the electrode portion 7 fixed thereto is bonded to the bottom surface of the case member 1 by an adhesive. In addition, the periphery of the sound guide port 11 is bonded to the inside wall 1*b* of the case member 1 by an adhesive 18.

Moreover, the cover member 2 is bonded to the case member 1 accommodating the carrier portion 5 having the diaphragm 6 and the electrode portion 7 fixed thereto with the frame member 3 interposed between the cover member 2 and the case member 1, and thereby the housing 4 is formed and the electroacoustic transducer according to the present invention is completed.

The inside space of the housing 4 is divided into a first acoustic chamber 16 and a second acoustic chamber 17. The first acoustic chamber 16 is defined by the carrier portion 5 and the diaphragm 6, and the second acoustic chamber 17 is the other portion of the inside space of the housing 4. Since the carrier portion 5 is formed in a saucer-like shape, it is possible to define the first acoustic chamber 16 only by bonding the diaphragm 6 to the surface 5*b* of the periphery of the carrier portion 5 and the end surfaces 10*a* of the posts 10 without taking sealing into consideration. Accordingly, it is easy to divide the inside space of the housing 4 into the first acoustic chamber 16 and the second acoustic chamber 17.

Sound waves enter from the sound inlet opening 9, pass a sound passage 1*a* provided in the side surface of the case member 1 and the sound guide port 11 formed in the carrier portion 5 to the first acoustic chamber 16, and reach the diaphragm 6. The sound pressure of the sound waves vibrates the diaphragm 6, which causes the variation in the capacitance between the diaphragm 6 and the electrode portion 7. As a result of this, the amplifier 8 outputs electrical signals depending on the sound waves.

Next, explanations will be made on the processes of producing the carrier portion 5 by an etching process with reference to FIGS. 5(*a*)–5(*e*). The shape of the carrier portion 5 can be formed by conducting an etching process to a metal plate with two photomasks having a different shape applied to each surface of the metal plate.

As shown in FIG. 5(*a*), resist layers 21*a*, 21*b* are respectively attached to both surfaces of a metal plate 20 which will form the carrier portion 5.

As shown in FIG. 5(*b*), photomasks 22*a*, 22*b* having a desired pattern are respectively attached to the resist layers 21*a*, 21*b*, and bases 23*a*, 23*b* for a photomask are respectively attached to the photomasks 22*a*, 22*b*. Ultraviolet rays are radiated to both surfaces, and thereby mask patterns of the photomasks 22*a*, 22*b* are exposed to the resist layers 21*a*, 21*b*.

As shown in FIG. 5(*c*), the photomasks 22*a*, 22*b* and the bases 23*a*, 23*b* for a photomask are removed, and thereafter the portion of the resist layers 21*a*, 21*b* which has been covered by the photomasks 22*a*, 22*b* is dissolved with a parting agent. The portion of the resist layers 21*a*, 21*b* which has not been covered by the photomasks 22*a*, 22*b* (hereinafter, referred to as resist layers 24*a*, 24*b*) is left on the metal plate 20.

Next, as shown in FIG. 5(*d*), both surfaces of the metal plate 20, which are exposed without being covered by the resist layers 24*a*, 24*b*, are dissolved with a strong acid so as to obtain a desired shape for the carrier portion 5.

Finally, as shown in FIG. 5(*e*), the resist layers 24*a*, 24*b* are dissolved with a different parting agent from the parting agent used in the above-mentioned process of FIG. 5(*c*) so as to obtain a desired shape for the carrier portion 5. The shape of the carrier portion 5 which is formed from the metal plate 20 can be determined depending on patterns of the photomasks 22*a*, 22*b*.

In addition, a sufficiently large metal plate 20 may be used which enables making of a plurality of carrier portions 5, and resist layers 21*a*, 21*b*, photomasks 22*a*, 22*b*, and bases 23*a*, 23*b* for a photomask which conform to such a metal plate are used, whereby a plurality of carrier portions 5 can be formed at the same time, and thereby high productivity and low costs can be achieved.

Industrial Applicability

According to an aspect of the present invention, since the carrier portion is formed in a saucer-like shape having a bottom portion rather than a frame shape, the carrier portion has a strong structure with respect to an external force and it is possible to prevent the tension of the diaphragm from being influenced by an external force. Since the surface of the periphery of the carrier portion and the end surfaces of the posts are in the same plane, uniform and desired tension of the diaphragm can be achieved. In addition, since the end surfaces of the posts are formed so as to be in the same plane by an etching process, it is easy to keep the diaphragm and the electrode portion parallel at a certain interval.

According to another aspect of the present invention, it is easy to keep the diaphragm and the electret layer of the electrode portion parallel at a certain interval.

According to another aspect of the present invention, since the carrier portion is formed in a saucer-like shape, it is possible to define the first acoustic chamber only by bonding the diaphragm to the surface of the periphery of the carrier portion and the end surfaces of the posts. Accordingly, it is easy to divide the inside space of the housing into the first acoustic chamber and the second acoustic chamber.

According to another aspect of the present invention, since the carrier portion is formed by etching processing, it is possible to prevent a strain or stress from being left in the carrier portion, such as may occur in a case of press processing. Since the carrier portion is formed by an etching process so as to have no influence of a strain nor stress, the variation in the tension of the diaphragm is kept to be uniform even when the ambient temperature varies. In addition, since the end surfaces of the posts are formed so as to be in the same plane by an etching process, it is easy to keep the diaphragm and the electrode portion parallel at a certain interval.

Although there has been described what is the present embodiment of the invention, it will be understood by persons skilled in the art that variations and modifications may be made thereto without departing from the gist, spirit or essence of the invention.

What is claimed is:

1. An electroacoustic transducer comprising:

a carrier portion;

a diaphragm supported by said carrier portion;

an electrode portion opposed to said diaphragm at a predetermined interval; and a housing accommodating said diaphragm and said electrode portion;

wherein said carrier portion has a saucer shape, at a bottom surface of which a plurality of posts are provided, a surface of a periphery of said carrier portion and end surfaces of said posts are in the same plane, said diaphragm is bonded to said surface of the periphery of the carrier portion and said end surfaces of the posts, and said electrode portion is fixed to said end surfaces of the posts which are covered by said diaphragm with spacers interposed therebetween.

2. The electroacoustic transducer according to claim 1, wherein said diaphragm is formed in a film shape having a conductive layer provided on one surface thereof, and said electrode portion has an electret layer and also has protruding portions provided on the surface of said electrode portion which faces said diaphragm, said protruding portions functioning as said spacers.

3. The electroacoustic transducer according to claim 2, wherein a sound guide port is provided at a bottom of said carrier portion, and an inside of said housing is divided into a first acoustic chamber and a second acoustic chamber by bonding the bottom of said carrier portion to a bottom surface of said housing and bonding a periphery of said sound guide port to an inside wall of said housing.

4. The electroacoustic transducer according to claim 2, wherein said carrier portion is formed by an etching process.

5. The electroacoustic transducer according to claim 1, wherein a sound guide port is provided at a bottom of said carrier portion, and an inside of said housing is divided into a first acoustic chamber and a second acoustic chamber by bonding the bottom of said carrier portion to a bottom surface of said housing and bonding a periphery of said sound guide port to an inside wall of said housing.

6. The electroacoustic transducer according to claim 5, wherein said sound guide port extends through the bottom of said carrier portion.

7. The electroacoustic transducer according to claim 5, wherein said first acoustic chamber is defined between the bottom surface of said carrier portion and said diaphragm, and said second acoustic chamber is defined between the diaphragm and the inside of said housing.

8. The electroacoustic transducer according to claim 5, wherein said carrier portion is formed by an etching process.

9. The electroacoustic transducer according to claim 1, wherein said carrier portion is formed by an etching process.

10. The electroacoustic transducer according to claim 7, wherein said carrier portion is metal and formed with substantially no residual stress or strain.

11. The electroacoustic transducer according to claim 1, wherein an upper surface of the periphery of said carrier portion and upper end surfaces of said posts are in the same plane.

12. The electroacoustic transducer according to claim 1, wherein said bottom surface of the carrier portion faces upwardly, and said periphery of the carrier portion surrounds said bottom surface and extends upwardly and downwardly therefrom.

13. An electroacoustic transducer comprising:

a carrier portion having a bottom surface and a periphery surrounding said bottom surface such that a recess is defined within an upper portion of the periphery above the bottom surface;

a diaphragm supported by said carrier portion;

an electrode portion opposed to said diaphragm at a predetermined interval;

a housing accommodating said carrier portion, said diaphragm and said electrode portion; and a plurality of posts extending upwardly from the bottom surface of said carrier portion;

wherein an upper surface of the periphery of said carrier portion and end surfaces of said posts are in a common plane, said diaphragm is bonded to said upper surface of the periphery and said end surfaces of the posts, and said electrode portion is fixed to said end surfaces of the posts which are covered by said diaphragm with spacers interposed therebetween.

14. The electroacoustic transducer according to claim 13, wherein said diaphragm is formed in a film shape having a conductive layer provided on one surface thereof, and said electrode portion has an electret layer and also has protruding portions provided on the surface of said electrode portion which faces said diaphragm, said protruding portions functioning as said spacers.

15. The electroacoustic transducer according to claim 13, wherein a sound guide port is provided at through a bottom of said carrier portion, and an inside of said housing is divided into a first acoustic chamber and a second acoustic chamber by bonding the bottom of said carrier portion to a bottom surface of said housing and bonding a periphery of said sound guide port to an inside wall of said housing.

16. The electroacoustic transducer according to claim 13, wherein said carrier portion is formed by an etching process such that the carrier portion has substantially no residual strain or stress.

* * * * *

UNITED STATES PATENT AND TRADEMARK OFFICE

CERTIFICATE OF CORRECTION

PATENT NO. : 6,804,363 B2
DATED : October 12, 2004
INVENTOR(S) : Yamasaki et al.

It is certified that error appears in the above-identified patent and that said Letters Patent is hereby corrected as shown below:

Column 2
Lines 21-23, please change "FIG.1 shows an enlarged cross-sectional view of a portion of the electroacoustic transducer according to the present invention;" to -- FIG.1 shows a cross-sectional view of an electoacoustic transducer according to the present invention; --;
Line 24, between "cross-sectional view of" and "the", insert -- a portion of --.

Column 6,
Line 8, please change "7," to -- 9, --.

Signed and Sealed this

Fourth Day of January, 2005

JON W. DUDAS
*Director of the United States Patent and Trademark Office*

UNITED STATES PATENT AND TRADEMARK OFFICE

CERTIFICATE OF CORRECTION

PATENT NO. : 6,804,363 B2
APPLICATION NO. : 10/297141
DATED : October 12, 2004
INVENTOR(S) : Yamasaki et al.

It is certified that error appears in the above-identified patent and that said Letters Patent is hereby corrected as shown below:

Column 2
Lines 21-23, please change "FIG.1 shows an enlarged cross-sectional view of a portion of the electroacoustic transducer according to the present invention;" to -- FIG.1 shows a cross-sectional view of an electroacoustic transducer according to the present invention; --;
Line 24, between "cross-sectional view of" and "the", insert -- a portion of --.

Column 6,
Line 8, please change "7," to -- 9, --.

This certificate supersedes Certificate of Correction issued January 4, 2005.

Signed and Sealed this

Twenty-second Day of August, 2006

JON W. DUDAS
*Director of the United States Patent and Trademark Office*